US006666733B2

(12) United States Patent
Takatsuki et al.

(10) Patent No.: US 6,666,733 B2
(45) Date of Patent: Dec. 23, 2003

(54) TERMINAL FITTING AND A CONNECTOR PROVIDED THEREWITH

(75) Inventors: Kozue Takatsuki, Yokkaichi (JP); Yuuichi Nankou, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/141,483

(22) Filed: May 8, 2002

(65) Prior Publication Data

US 2003/0068932 A1 Apr. 10, 2003

(30) Foreign Application Priority Data

May 10, 2001 (JP) ..... 2001-140023

(51) Int. Cl.[7] ..... H01R 13/02
(52) U.S. Cl. ..... 439/884; 439/866
(58) Field of Search ..... 439/852, 866, 439/884, 948, 842, 843

(56) References Cited

U.S. PATENT DOCUMENTS

| | | | | |
|---|---|---|---|---|
| 5,681,192 A | | 10/1997 | Kobayashi et al. | |
| 5,702,272 A | * | 12/1997 | Machida | 439/843 |
| 6,398,599 B1 | * | 6/2002 | Irikura et al. | 439/884 |
| 6,402,575 B1 | * | 6/2002 | Suzuki | 439/884 |

* cited by examiner

*Primary Examiner*—Tho D. Ta
(74) *Attorney, Agent, or Firm*—Gerald E. Hespos; Anthony J. Casella

(57) ABSTRACT

A terminal fitting (1) has a rectangular tubular box-shaped portion (5) with an engaging hole (9). An entrance preventing wall (10, 11) extends from an edge of the engaging hole (9) toward an opposed wall (8B) of the box-shaped portion (5). Thus the entrance preventing wall (10, 11) blocks entry of a male tab (3) of another terminal fitting through the engaging hole (9) and into the barrel the box-shaped portion (5).

6 Claims, 3 Drawing Sheets

TERMINAL FITTING AND A CONNECTOR PROVIDED THEREWITH

BACKGROUND OF THE INVENTION

1. Field of the Invention

The invention relates to a terminal fitting and to a connector.

2. Description of the Related Art

U.S. Pat. No. 5,681,192 discloses a connector that has a housing formed with cavities and terminal fittings that are inserted into the respective cavities. Each terminal fitting is formed by bending a metallic plate material and has opposite front and rear ends. A long narrow flat male tab is formed at the front end of the male terminal fitting and is configured for connection with a female terminal fitting. A substantially rectangular tubular box-shaped portion is formed rearward of the male tab, and a barrel is provided behind the box-shaped portion. The barrel is configured for crimped connection with a wire.

The front of the box-shaped portion is closed and continuous with the male tab. However, the rear of the box-shaped portion is open. Additionally, a locking hole is formed in one side wall of the box-shaped portion for engagement with the leading end of an elongate lock cantilevered from an inner wall of the cavity in the housing to lock the terminal fitting in the cavity.

The above-described connector is produced by first employing a crimping apparatus to crimp the barrels of the terminal fittings into connection with the wires. A plurality of the crimped terminal fittings then are aligned in the same direction and the wires are bundled together. The bundled assemblies then are transported to the site of an assembling process, and the terminal fittings are inserted into the cavities. However, the male tab of one terminal fitting may obliquely enter and get stuck in the rear opening or locking hole of another terminal fitting. The male tab may be bent if an external force acts on the stuck terminal fitting, thereby resulting in a defective terminal fitting.

In view of the above, an object of the invention is to provide a terminal fitting that can prevent another terminal fitting from entering the box-shaped portion when being bundled with a multitude of other terminal fittings. A further object is to provide a connector comprising such a terminal fitting.

SUMMARY OF THE INVENTION

The invention is directed to a terminal fitting with a box-shaped portion and at least one opening in the box-shaped portion. At least one entrance preventing means is provided on the terminal fitting for preventing another terminal fitting from passing through the opening and into the box-shaped portion.

The opening in the box-shaped portion may be an engaging hole for receiving a lock formed in a cavity of a connector housing for locking the terminal fitting in the cavity. The entrance preventing means may be a wall at an edge of the opening and may extend toward an opposed wall of the box-shaped portion.

The entrance preventing wall is dimensioned, disposed and configured to prevent a male tab of another terminal fitting from entering box-shaped portion. Accordingly, the male tab cannot get stuck, and deformation of the male tab is prevented.

The box-shaped portion preferably has opposed spaced-apart first and second walls and the entrance preventing wall preferably extends substantially between the first and second walls and preferably is substantially normal to at least one of the first and second walls. The first wall may be a bottom wall of the box-shaped portion and the second wall may be a ceiling wall of a box-shaped portion.

The terminal fitting may be a male terminal fitting with opposite front and rear ends. A male tab may be disposed at the front end of the terminal fitting and the box-shaped portion may be rearward of the male tab. A plurality of the male terminal fittings may be bundled to form a wiring harness or a wiring harness subassembly with the male tabs pointing in the same direction. Thus one male tab may inadvertently move forwardly into the opening of another terminal fitting. Accordingly, the entrance preventing wall preferably is at a front side of the edge of the opening of the box-shaped portion. Thus, the entrance of the male tab of the other terminal fitting can be prevented.

The invention also is directed to a connector with a housing and at least one cavity formed in the housing. The housing may have a resiliently deflectable lock cantilevered to extend into the cavity. The connector further comprises at least one terminal fitting with a box-shaped portion that conforms to the shape of a cavity in the housing. The box shaped is formed with at least one opening and at least one entrance preventing wall, as described above. More particularly, an entrance preventing wall is provided at an edge of the opening for preventing a male tab of another terminal fitting from entering the box-shaped portion.

The invention will be described below by way of an example of preferred embodiments and accompanying drawings. Although the described embodiments refer to male terminal fittings, it should be understood that the invention may also be applied to female terminal fittings.

DETAILED DESCRIPTION OF THE PREFERRED EMBODIMENTS

Figure 1:
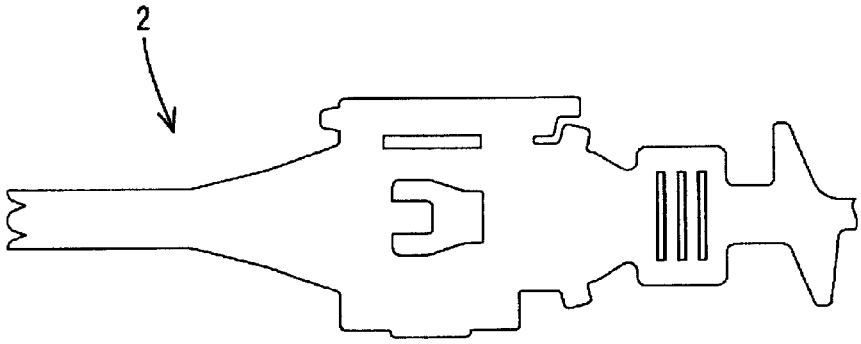
FIG. 1 a plan view of a blank of metal for forming a terminal fitting in accordance with the invention.
Figure 2:
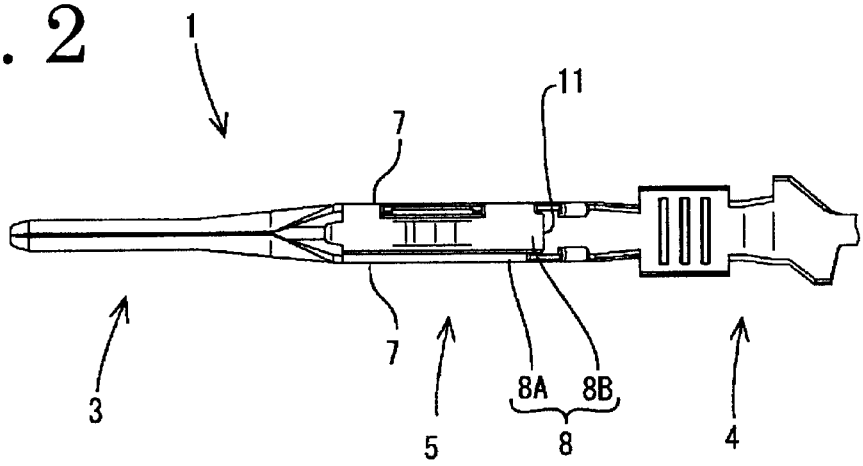
FIG. 2 is a plan view of the formed male terminal fitting.
Figure 3:
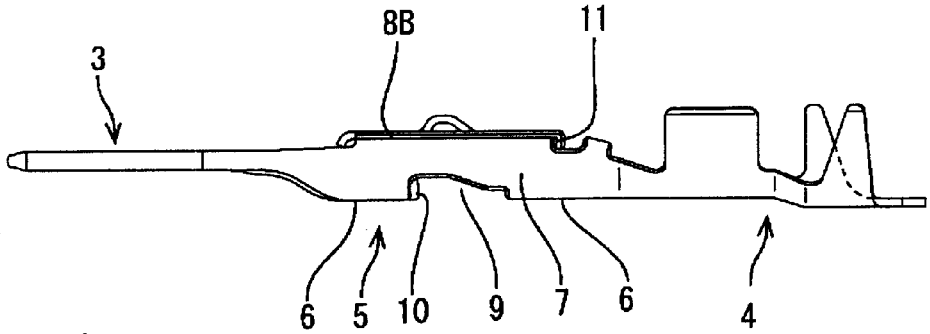
FIG. 3 is side view of the male terminal fitting shown in FIG. 2.
Figure 6:
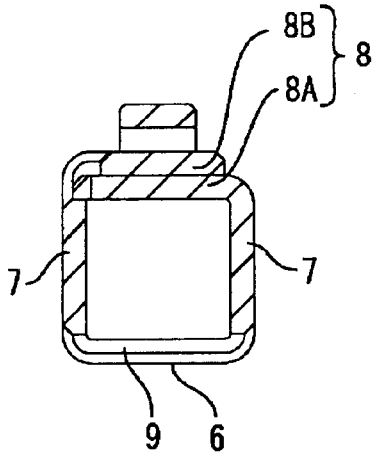
FIG. 6 is a lateral section of the male terminal fitting shown in FIG. 1.

A male terminal fitting 1 according to invention is formed by bending a metallic plate material 2 stamped into a shape as shown in FIG. 1 and having a specified thickness. In the following description, the left side in FIGS. 1 to 5 is referred to as the front side and reference is made to FIGS. 3, 5 and 6 concerning the vertical direction.

The male terminal fitting 1 includes a long, narrow flat tab 3 that extends rearwardly from the front end of the male terminal fitting 1. The tab 3 is intended be fit into an unillustrated female terminal fitting. A barrel 4 extends forwardly from the rear end of the male terminal fitting 1 and is configured for crimped connection with an end of an unillustrated wire. A box-shaped portion 5 is formed between the tab 3 and the barrel 4.

The box-shaped portion 5 is a substantially rectangular tube with a bottom wall 6, two side walls 7 that extend vertically up from the left and right edges of the bottom wall 6, and a ceiling wall 8 that extends between the side walls 7 and parallel with the bottom wall 6. The ceiling wall 8 includes an inner ceiling wall 8A bent inwardly from one of the side walls 7 at a specified height so as to face the bottom wall 6, and an outer ceiling wall 8B bent in from the other side wall 7 and placed on the upper surface of the inner ceiling wall 8A.

Figure 4:
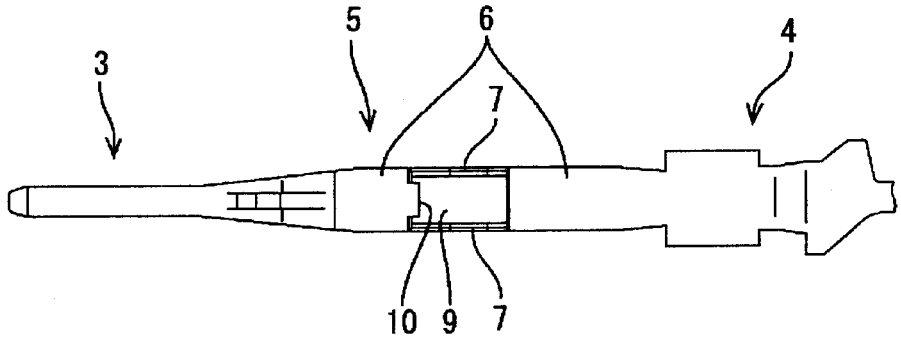
FIG. 4 is a bottom view of the male terminal fitting shown in FIG. 2.
Figure 5:
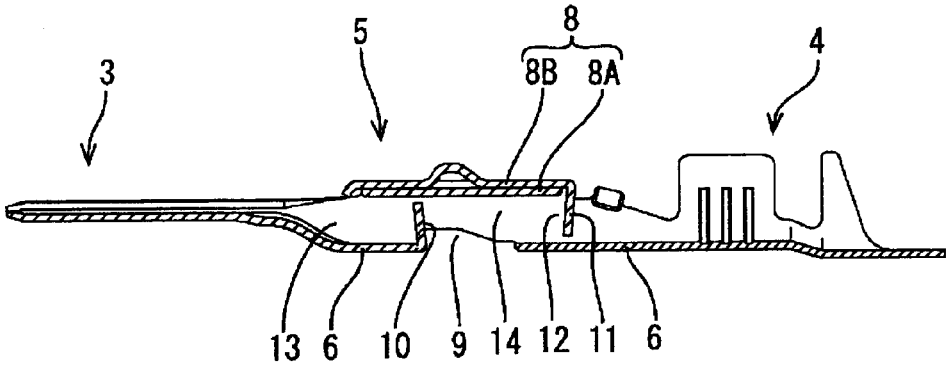
FIG. 5 is a longitudinal section of the male terminal fitting of FIG. 2.

As shown in FIG. 4, the bottom wall 6 of the box-shaped portion 5 is formed with an engaging hole 9 that extends over the entire width of the bottom wall 6 at substantially a middle position with respect to forward and backward directions. The terminal fitting can be locked in a cavity of an unillustrated connector housing by engaging the leading end of a cantilever-shaped lock formed in an inner wall of the cavity with the engaging hole 9.

A rectangular first entrance preventing wall 10 is provided in the box-shaped portion 5. This first preventing wall 10 is continuous with the edge of the engaging hole 9 at a side toward the tab 3 and extends toward the inner surface of the inner ceiling wall 8A, such that the upper end of the first preventing wall 10 is in the vicinity of the inner surface of the inner ceiling wall 8A. Thus, the first preventing wall 10 covers substantially the entire area between the front edge of the engaging hole 9 and the inner surface of the inner ceiling wall 8A above the front edge.

The box-shaped portion 5 further has a second rectangular entrance preventing wall continuous with the rear edge of the outer ceiling wall 8B and suspended therefrom so as to cover substantially the entire area of a rectangular opening 12 at the rear of the box-shaped portion 5.

A connector having the male terminal fittings 1 is produced by first crimping the barrels 4 of the male terminal fittings 1 into connection with ends of wires. The male terminal fittings 1 are transported to a site of an assembling process and inserted into cavities formed in a connector housing. A plurality of terminal fittings crimped into connection with the wires are aligned in the same direction, bundled and transported to the assembly site of in this state.

The male terminal fittings 1 may be shaken during transportation, and the leading end of the tab 3 of one terminal fitting 1 may try to enter the engaging hole 9 or the opening 12 in the box-shaped portion 5 of another terminal fitting 1. However, the leading end of a tab 3 that moves forwardly into the engaging hole 9 of the box-shaped portion 5 and toward a space 13 adjacent the tab 3 of the other terminal fitting 1 will strike against the first preventing wall 10 and will be unable to enter any further. Thus, the leading end of the tab 3 cannot enter the space 13. Similarly, a tab 3 that moves forwardly into the opening at the rear end of the box-shaped portion 5 and toward a space 14 inside the box-shaped portion 5 will strike against the second preventing wall 11.

Thus, the leading end of the tab 3 cannot enter the space 14. Therefore, the tab 3 is prevented from being stuck obliquely in the box-shaped portion 5 of the other terminal fitting 1, and will not be deformed from such an inadvertent engagement.

In summary, deformation of a terminal fitting is prevented by entrance preventing walls 10, 11 continuous respectively with the edge of the engaging hole 9 and the outer ceiling wall 8B. A male tab that tries to enter a space 13 of the box-shaped portion 5 toward the tab 3 or a space 14 of the box-shaped portion 5 toward the barrel 4 is blocked by one of the entrance preventing walls 10, 11 and cannot enter any further. Thus, the tab does not enter the spaces 13, 14 inside the box-shaped portion 5 and deformation is prevented.

The present invention is not limited to the above described and illustrated embodiment. For example, following embodiments are also embraced by the technical scope of the present invention.

The invention is applied to a male terminal fitting in the foregoing embodiment. However, it may be applied to female terminal fittings.

The entrance preventing wall is provided at the front edge of the engaging hole in the foregoing embodiment. However, it may also be provided at the rear edge thereof.

The entrance preventing wall is continuous with the outer ceiling wall in the foregoing embodiment. However, it may be continuous with the inner ceiling wall.

What is claimed is:

1. A terminal fitting having opposed front and rear ends, a male tab mating portion formed adjacent the front end and configured for mating with another terminal fitting, a wire engaging portion adjacent the rear end and configured for mating with a wire, a substantially rectangular tubular box-shaped portion between the mating portion and the wire engaging portion, the box shaped portion having opposed top and bottom walls, an opening formed in the bottom wall and located within the box-shaped portion, and an entrance preventing wall extending unitarily from the bottom wall substantially to the top wall adjacent the opening and between the opening and the mating portion for preventing a male tab of another terminal fitting from entering the box-shaped portion.

2. The terminal fitting of claim 1, wherein the entrance preventing wall is unitary with the box-shaped portion.

3. The terminal fitting of claim 2, wherein the entrance preventing wall is a first entrance preventing wall, the top wall comprising inner and outer top panels disposed in overlapping face-to-face engagement with one another, the terminal fitting further comprising a second entrance preventing wall extending unitarily from the outer top panel on an end of the box-shaped portion substantially adjacent the wire engaging portion for preventing another terminal fitting from entering the box-shaped portion substantially adjacent the wire engaging portion.

4. The terminal fitting of claim 3, wherein the wire engaging portion is a barrel configured for crimped connection with a wire.

5. A connector comprising a housing with a cavity and at least one terminal fitting having a box-shaped portion with at least one opening formed therein, the box shaped portion having a bottom wall and inner and outer top panels disposed in overlapping face-to-face engagement with one another and at least one entrance preventing wall extending unitarily from the outer top panel substantially adjacent an end of the inner top panel and continuing substantially to the bottom wall for preventing another terminal fitting from entering the box-shaped portion, the box-shaped portion of the terminal fitting conforming to the shape of a cavity formed in the housing.

6. A terminal fitting having opposed front and rear ends, a mating portion formed adjacent the front end and configured for mating with another terminal fitting, a wire engaging portion adjacent the rear end and configured for mating with a wire, a substantially rectangular tubular box-shaped portion between the mating portion and the wire engaging portion, the box-shaped portion having opposed top and bottom walls, the top wall being formed from inner and outer top panels disposed in overlapping face-to-face engagement with one another, an entry preventing wall extending unitarily from the outer top panel on an end of the box-shaped portion substantially adjacent the inner top panel and substantially adjacent the wire engaging portion, the entry preventing wall extending substantially to the bottom wall for preventing another terminal fitting from entering the box-shaped portion substantially adjacent the wire engaging portion.

* * * * *